United States Patent [19]

Beam

[11] Patent Number: 4,608,786

[45] Date of Patent: Sep. 2, 1986

[54] DOWNSPOUT FOR BUILDING GUTTERS OR THE LIKE

[76] Inventor: Tony D. Beam, P.O. Box 777, Stanley, N.C. 28164

[21] Appl. No.: 807,290

[22] Filed: Dec. 10, 1985

[51] Int. Cl.[4] ..... E04D 13/08

[52] U.S. Cl. ..... 52/16; 52/11; 52/12; 210/320; 405/119

[58] Field of Search ..... 52/11, 12, 16; 210/320, 210/801, 521; 405/119, 118, 80

[56] References Cited

U.S. PATENT DOCUMENTS

| | | | |
|---|---|---|---|
| 546,042 | 9/1895 | Van Horn | 52/12 |
| 603,611 | 5/1898 | Nye | 52/12 |
| 836,012 | 11/1906 | Cassen | 52/12 |
| 891,405 | 6/1908 | Cassen | 52/12 X |
| 2,669,950 | 2/1954 | Bartholomew | 52/12 |
| 2,672,832 | 3/1954 | Goetz | 52/12 |
| 2,898,939 | 8/1959 | Fox | 405/119 |
| 3,638,369 | 2/1972 | Albrecht | 52/16 |
| 4,040,256 | 8/1977 | Bosche et al. | 405/119 |
| 4,241,547 | 12/1980 | Bové | 52/16 X |
| 4,258,510 | 3/1981 | Guiana | 52/16 X |
| 4,404,775 | 9/1983 | DeMartini | 52/12 |
| 4,450,654 | 5/1984 | Clendenin | 52/12 |
| 4,497,146 | 2/1985 | DeMartini | 52/11 X |

FOREIGN PATENT DOCUMENTS

| | | | |
|---|---|---|---|
| 22622 | 3/1978 | Japan | 52/16 |
| 135024 | 11/1978 | Japan | 52/11 |
| 137421 | 11/1978 | Japan | 52/16 |
| 137422 | 11/1978 | Japan | 52/16 |
| 108928 | 8/1979 | Japan | 52/11 |
| 143919 | 11/1979 | Japan | 52/11 |
| 153322 | 12/1979 | Japan | 52/16 |
| 54154 | 5/1928 | Sweden | 405/119 |

*Primary Examiner*—Alfred C. Perham

*Attorney, Agent, or Firm*—Shefte, Pinckney & Sawyer

[57] ABSTRACT

A downspout structure adapted to be utilized with a conventional gutter on a building structure to discharge run-off water to a drainage location, including an elongate generally U-shaped open downspout member having an interior water deflector arrangement along substantially the length thereof forming wettable surfaces adapted for causing run-off water contacting the deflector arrangement to flow sheetingly therealong to retain the run-off water within the downspout member. Leaves and other debris are transported through the downspout member by the sheeting water run-off and the open nature of the downspout member permits expulsion of such debris to substantially prevent clogging of the downspout structure.

19 Claims, 13 Drawing Figures

DOWNSPOUT FOR BUILDING GUTTERS OR THE LIKE

BACKGROUND OF THE INVENTION

The present invention relates to downspout structures of the type used for discharging run-off water from a building gutter or the like.

An important design criteria in the planning and construction of building structures is the collection and removal of rainwater and the like from the roof and foundational areas surrounding the building structure to avoid potential structural damage thereto by flooding of the structure and/or erosion of the surrounding earth. Accordingly, it is a common practice, particularly in home construction, to provide rain gutters at the outward terminal edges of the building roof together with downspouts communicating with the gutters to collect and direct water runoff from the roof away from the building.

A long-standing and yet substantially unsolved problem associated with the use of conventional rainwater ducting systems is the undesired collection of leaves, twigs, pine needles and other debris in the gutters and downspouts, which inhibits the proper functioning of the ducting system for water collection and drainage and ultimately causes complete clogging of the system. Often, such clogging occurs in the vertical downspouts which connect with the building gutters for receiving the collected run-off water from the building gutter and directing the water away from the building to a drainage or other discharge location.

A number of apparent disadvantages result. Accumulation of debris in the ducting system creates an increased water load on the system, particularly the gutter structure, and on the supporting structural members of the building, thereby creating a risk of structural damage to one or both thereof. In addition, ducting systems having accumulated debris therein are more prone to flooding over the gutter edges, posing a further risk of flooding and water damage to the building structure. Furthermore, the gutters and downspouts having collected debris therein are highly subject to premature corrosion and possible freezing damage during the winter months. Accordingly, it has traditionally been necessary to manually clear conventional ducting systems of accumulated debris over a periodic basis, but such maintenance measures still serve only to minimize the effects of, rather than eliminate, debris accumulation.

In the past, various solutions to the above-described problems have been proposed. For instance, screen-like gutter inserts are available to cover the open top of conventional trough-like gutters to permit water to flow thereinto while preventing leaves and other debris from entering the gutters. However, in actual practice, it has been found that such screens merely serve to collect leaves, pine needles and the like thereon requiring that the screens themselves be periodically cleared of accumulated debris. On the other hand, various deflector members as well as entirely redesigned gutter structures have been proposed having the two-fold purpose of permitting water drainage while preventing debris accumulation. Representative examples of such deflectors and gutter structures are disclosed in U.S. Pat. Nos. 546,042; 603,611; 836,012; 891,405; 2,669,950; 2,672,832; 4,404,775; and 4,497,146. In U.S. Pat. Nos. 3,638,369 and 4,241,547, there are disclosed auger mechanisms rotatably positioned within the gutters and/or downspouts of conventional rainwater ducting systems for preventing the clogging thereof. U.S. Pat. No. 4,258,510 discloses a deflector trough adapted for attachment to the roof beams of a building to deflect rainwater away therefrom, without utilizing any guttering or downspout structures.

In contrast, the present invention provides a novel improvement in the basic structure of gutter downspouts, which is uniquely effective to control the flow of run-off water while preventing downspout clogging and facilitating easy cleaning thereof.

SUMMARY OF THE INVENTION

Briefly described, the downspout structure of the present invention includes a downspout member defining an elongate generally U-shaped open channel adapted for generally upright disposition for receiving run-off water adjacent an upper end of the member and directing the run-off water to a lower discharge end of the member. The downspout member includes a water deflector arrangement interiorly of the channel along the length thereof for controlling the flow of the run-off water to retain it within the channel, the open channel permitting the expulsion of leaves and other debris from the channel to prevent clogging thereof and to facilitate easy cleaning thereof.

In the preferred embodiment of the downspout structure, the deflector arrangement forms a wettable surface adapted for causing run-off water contacting the deflector to flow sheetingly therealong to the lower discharge end of the member for causing the run-off water to be retained within the channel and for transporting leaves and other debris through the channel to prevent clogging thereof. The downspout structure includes a neck member for mounting to the downspout member at its upper end to extend between a gutter and the downspout member for diverting run-off water into contact with the deflector arrangement at the upper end of the downspout member.

In several embodiments of the downspout structure, the wettable surface of the deflector arrangement extends continuously for substantially the entire length of the channel. The wettable surface may be of a serpentine-like surface configuration such as formed by a sinuous-shaped deflector plate extending substantially the entire length of the channel to present a sinuous wettable surface on each opposite side of the plate or as provided by a plurality of circular members arranged in stacked relation along the length of the channel to present continuous serpentine-like wettable surfaces along the opposite lateral sides of the stacked arrangement of the circular members. In the first-mentioned form, a pair of the deflector plates may be arranged side-by-side transversely across the channel. In the second-mentioned form, the stacked circular members may be spherical in shape or, alternatively, may be cylindrical in shape and stacked in axially parallel arrangement. In both forms, a deflector flange may be provided at the uppermost end of the deflector arrangement to deflect leaves and other debris to prevent clogging. In another embodiment, the continuous wettable surface may be formed by transversely convex surface portions at and extending inwardly from each side of the channel, preferably by providing the downspout member with corrugations in transverse section along substantially the entire length of the channel. In a further embodiment, the continuous wettable surface of the deflector arrangement is provided by a plurality of deflector partition plates extending side-by-side along substantially the entire length of the channel, the plates being arranged in substantially parallel relation to one another at a slight angle with respect to vertical to insure contact of the run-off water with the plates. In this embodiment, the deflector plates have corresponding respective upper edges extending angularly downwardly and outwardly of the channel to expel leaves and like debris outwardly from the channel.

According to another embodiment of the downspout structure, the deflector arrangement does not present a continuous wettable surface but instead includes a plurality of deflector members arranged angularly relative to the longitudinal extent of the channel in transversely staggered relation at spacings along the length of the channel.

DESCRIPTION OF THE PREFERRED EMBODIMENT

Figure 1:
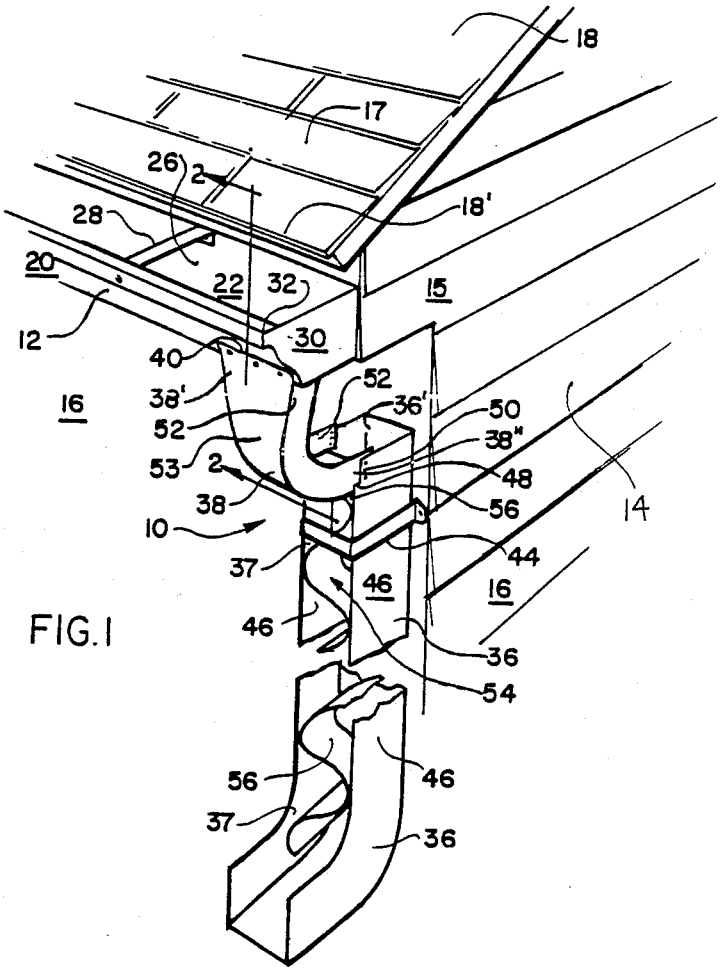
FIG. 1 is a perspective view of a rainwater ducting system on a building structure incorporating one embodiment of a downspout structure according to the present invention.
Figure 2:
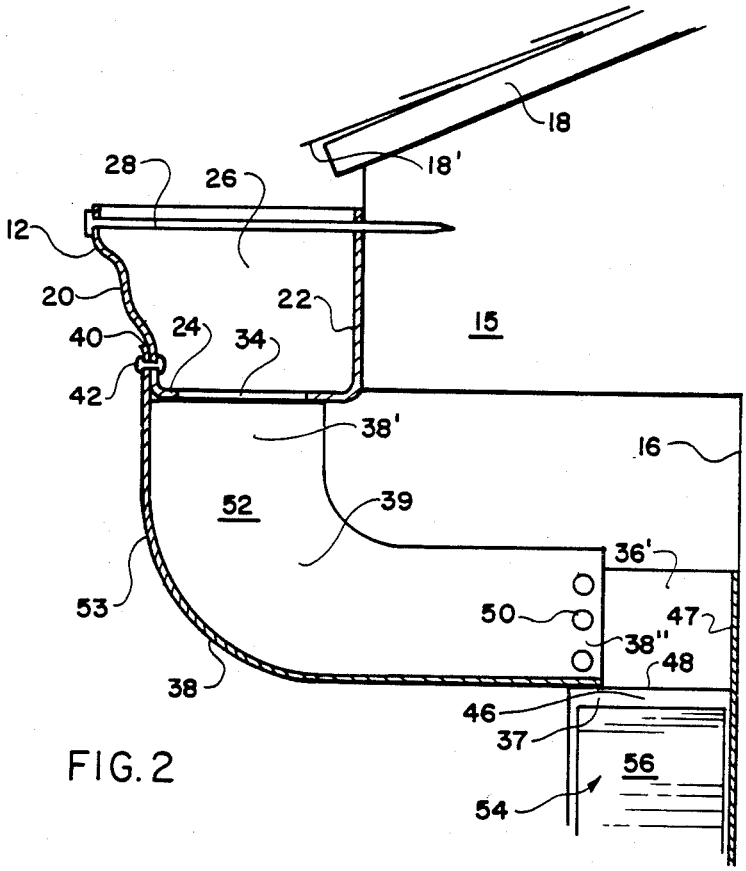
FIG. 2 is a vertical cross-sectional view of the ducting system of FIG. 1 taken along line 2—2 thereof.

Referring now to the accompanying drawings and initially to FIGS. 1 and 2, a downspout structure according to the present invention is indicated generally at 10 as preferably installed in assembly with a conventional gutter 12 mounted on a building structure 14. The building structure 13 is representative of a conventionally-constructed single family dwelling or home having vertical exterior walls 16 over which is constructed an angularly-related gable roof 18. As is conventional, each outward and downward terminal edge 18′ of the roof 18 extends slightly beyond the adjacent wall 16 of the building structure 14 to form an eave 15. The roof 18 is preferably covered by shingles 17 or another conventional roofing material.

The gutter 12 is of the conventional so-called seamless type formed from continuous length aluminum sheeting to have integral upright front and rear walls 20,22 and a bottom wall 24 extending transversely therebetween to define a collecting trough 26 having an open top. The gutter 12 is mounted on the outward face of the eave 15 of the building structure 14 immediately beneath the terminal edge 18′ of the roof 18 with the rear wall 22 of the gutter 12 flush against the eave 15 and rigidly affixed thereto by spikes 28. The opposite ends of the gutter 12 are closed by end caps 30 having a shape corresponding to the cross-sectional shape of the gutter 12 and formed with peripheral channel portions 32 to snuggly receive the end edges of the front, rear and bottom walls 20,22,24 of the gutter 12. The bottom wall 24 of the gutter 12 is provided with an opening 34 at at least one end thereof adapted to be fitted with a conventional tubular downspout (not shown) to extend downwardly from the gutter 12 to a water discharge location.

In conventional operation of the gutter 12 with a conventional tubular downspout, water from rain, melting snow, etc., flows downwardly along the roof 18, over its terminal edge 18′ and into the collecting trough 26 of the gutter 12. The gutter 12 is installed on the building eave 15 at a slightly inclined pitch with respect to horizontal to cause water in the collecting trough 26 to flow toward the opening 34 and into the conventional tubular downspout. The top opening to the trough 26 being substantially open and unrestricted, falling leaves, twigs, shingle granules, pine needles and like debris falling on or from the roof 18 are carried with the run-off water along the roof 18, into the trough 26 of the gutter 12, and to the downspout opening 34. Typically, conventional tubular downspouts are not of sufficient diameter to permit passage of such debris therethrough. Accordingly, such debris typically accumulates in the downspout 36 and, without periodic removal and cleaning, will ultimately clog the downspout 36 altogether. Conventional gutter cover members are effective to decrease to some limited extent, but not to altogether prevent, the amount of leaves and other debris entering the gutter trough 26, but nevertheless ultimately such debris will accumulate to a sufficient extent to produce clogging of the downspout as well as the trough 26.

Figure 4:
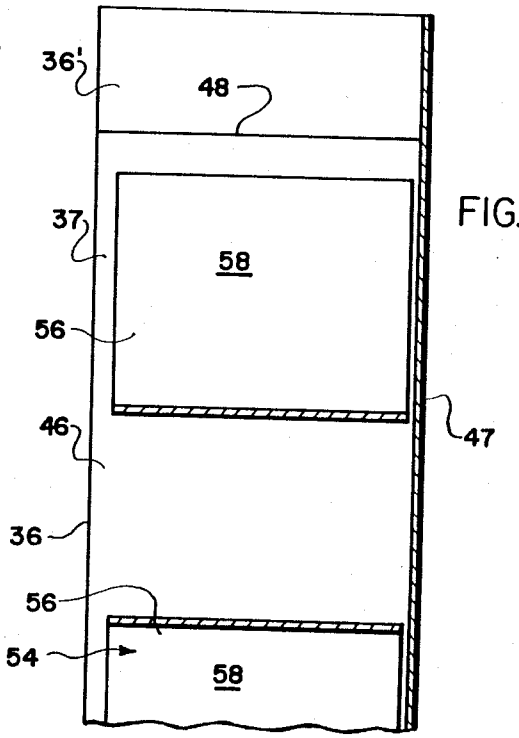
FIG. 4 is a vertical cross-sectional view of the downspout member of FIG. 3 taken along line 4—4 thereof.
Figure 3:
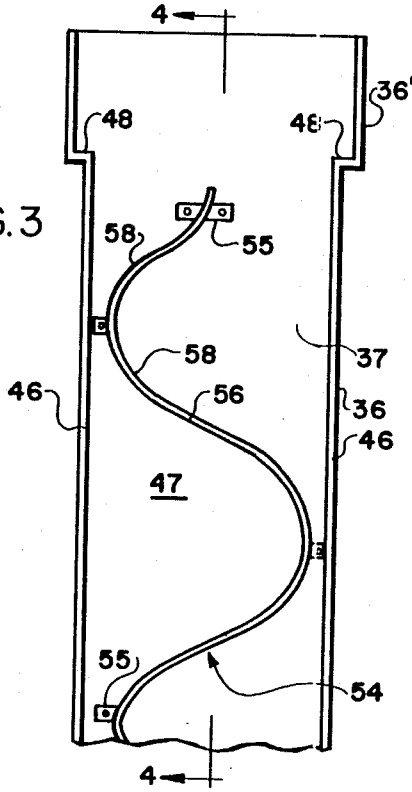
FIG. 3 is a front elevational view of the downspout member of FIG. 1.

The downspout structure 10 of the present invention substantially alleviates this problem. As best seen in FIGS. 3 and 4, the downspout structure 10 basically includes an elongate generally U-shaped open downspout member 36 and a curved generally U-shaped open neck member 38. The downspout member 36 is formed of continuous length aluminum, or another suitable material such as plastic, to have integral side walls 46 and a transverse rear wall 47 extending therebetween to define an open channel 37 of a generally uniform cross-sectional area. The neck member 38 is similarly formed of continuous length aluminum or plastic with integral side walls 52 and a transverse bottom wall 53 defining a channel 39, the transverse wall 53 being tapered along its length to form the channel 39 of a gradually decreasing channel width. The transverse wall 53 of the neck member 38 at its larger end 38' is provided with a projecting flange 40 adapted to be affixed by sheet metal screws 42 to the outer surface of the front gutter wall 20 adjacent the downspout opening 34 to extend rearwardly from the gutter 12 beneath the eave 15 to position the smaller end 38" of the neck member 38 at a slight outward spacing from the adjacent building wall 16 with the defined channel 39 of the neck member 38 facing upwardly immediately beneath the downspout opening 34 of the gutter 12 to receive run-off water discharged by the gutter 12 therethrough. The downspout member 36 is adapted to be affixed in ordinary fashion to the outer building wall 16 by brackets 44 or the like in upright disposition with the transverse wall 47 abutted against the building wall 16 to extend from the terminal rearward end 38" of the neck member 38 downwardly to a designated run-off water discharge location. Substantially the entire length of the downspout member 36 is of a slightly smaller channel width than the rearward end 38" of the neck member 38, the side walls 46 of the downspout member 36 at its upper end 36' being formed with outwardly extending shoulders 48 adapted to receive and support the side and transverse walls 52,53 at the rearward end 38" of the neck member 38, with sheet metal screws 50 being utilized to affix the side walls 52 of the neck member 38 to the side walls 46 of the downspout member 36 thereat. The lower discharge end 36" of the downspout member 36 may be formed with a curved discharge section to direct discharged water outwardly away from the building 14.

According to the present invention, a deflector arrangement indicated generally at 54 is disposed interiorly of the channel 37 defined by the downspout member 36 along substantially the length thereof to form wettable surfaces to be contacted by run-off water directed into the channel 37 to cause the water to flow sheetingly along the surfaces to the lower discharge end of the downspout member 36 to cause the run-off water to be retained within the channel 37. In the embodiment of the downspout structure 10 shown in FIGS. 1–4, the deflector arrangement 54 is a continuous elongate sinuous plate 56 affixed along one longitudinal edge thereof to the transverse wall 47 of the downspout member 36 by flange portions 55 to extend substantially the length of the channel 37 thereof to present a sinuous wettable surface 58 on each opposite side of the plate 56. The amplitude of the wave form of the sinuous plate 56 is selected to provide the deflector plate 56 with a transverse dimension extending laterally within the channel 37 to occupy the predominate amount of the width of the channel 37.

In operation, run-off water from the roof 18 of the building structure 14, together with leaves and like debris, collect in the trough 26 of the gutter 12 and flow through the downspout opening 34 into the channel 39 of the neck member 38 which directs the run-off water and debris into the channel 37 of the downspout member 36 at its upper end 36'. As desired, the downspout opening 34 of the gutter 12 may be formed of a considerably larger dimension than with conventional tubular downspouts to better insure that all leaves and like debris entering the gutter 12 will pass through the opening 34 into the neck member 38, the transverse wall 53 of the neck member 38 being dimensioned at its larger end to be slightly wider than the corresponding dimension of the downspout opening 34 to receive such debris. The run-off water and debris fall gravitationally from the rearward terminal end 38" of the neck member 38 with substantially all of the run-off water contacting one side or the other of the deflector plate 56. The side surfaces 58 of the deflector plate 56 provide wettable surfaces along which the water flows sheetingly following the sinuous contour of the plate 56 under the effect of surface tension between the water and the surfaces 58, thereby causing the run-off water to be retained within the open channel 37. At the same time, the open channel 39 of the neck member 38 and the open channel 37 of the downspout member 36 will be understood to be far less susceptible to clogging by leaves and like debris flowing from the gutter 12 into the downspout structure 10. Furthermore, the sheeting action of the run-off water flowing along the wettable surfaces 58 is uniquely effective to cause leaves and other debris to be transported through the channel 37 of the downspout member 36 and to be discharged therefrom at the lower discharge end of the downspout member 36 to prevent clogging of the channel 37. Additionally, the open nature of the channels 37, 39 permit the ready expulsion of leaves and other debris therefrom along the entire length of the downspout and neck members 36,38 to further prevent clogging thereof and to facilitate easy cleaning thereof. The open nature of the channels 37,39 enables the downspout structure 10 to handle larger amounts of run-off water at greater flow rates than conventional tubular downspouts, which also serves to reduce the likelihood of clogging of the downspout structure 10. It is contemplated that a run-off water ducting system on a building structure will function most effectively when the downspout structure 10 is utilized in conjunction with some form of deflector or cover member for the gutter 12 to reduce to at least some extent the amount of leaves and other debris entering the gutter 12 and subsequently passing into the downspout structure 10.

As those persons skilled in the art will readily recognize, the novel basic structural and operational concepts of the downspout structure of the present invention may be embodied equally well in many diverse downspout structures other than that of FIGS. 1–4. By way of example, six other embodiments of downspout structures incorporating the concepts and principals of the present invention are shown in FIGS. 5–12. The downspout structure of FIG. 5 basically incorporates a pair of the sinuous deflector plates 56 of FIGS. 1–4 mounted edgewise to the transverse wall 47 of a downspout member 36 in side-by-side mirror image relation transversely across the channel 37 thereof to provide four wettable surfaces 58 respectively along the opposite sides of the pair of plates 56. Preferably, an inverted fork-like deflector flange 59 is also mounted to the transverse wall 47 of the downspout member 36 directly above and extending transversely intermediately of the pair of deflector plates 56 to direct the run-off water onto each plate 56 and to deflect leaves and like debris outwardly to prevent such debris from coming to rest horizontally across the upper edges of the deflector plates 56 to prevent clogging of the channel 37 in such area. By utilizing a pair of the deflector plates 56 in this manner, the downspout member 36 may be constructed of a greater channel width than the downspout member 36 of FIGS. 1–4 to permit the handling of larger quantities and greater flow rates of run-off water effectively in the same manner as the single deflector plate 56 of FIGS. 1–4.

Figure 6:
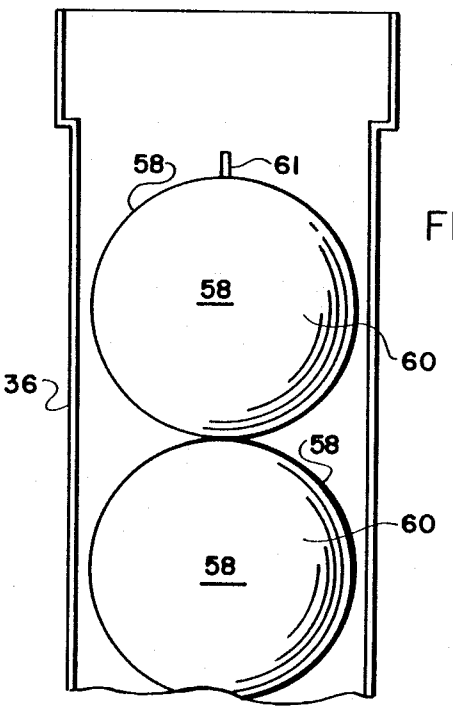
FIG. 6 is a front elevational view of a third embodiment of downspout member according to the present invention.
Figure 5:
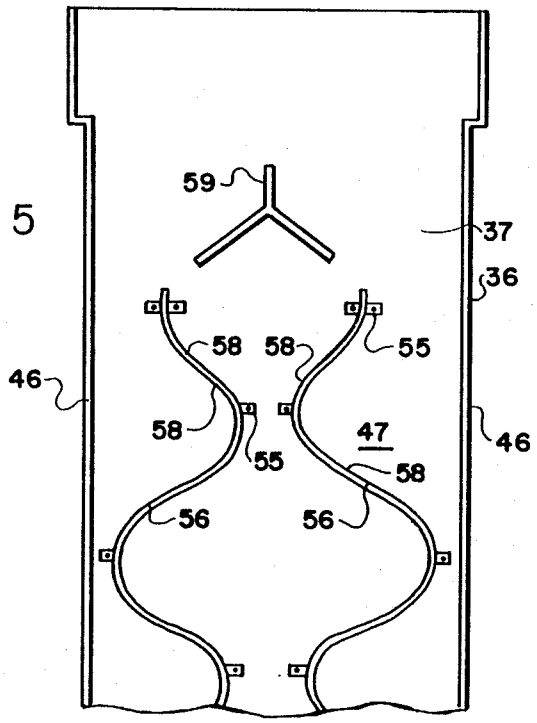
FIG. 5 is a front elevational view of a second embodiment of downspout member according to the present invention.
Figure 7:
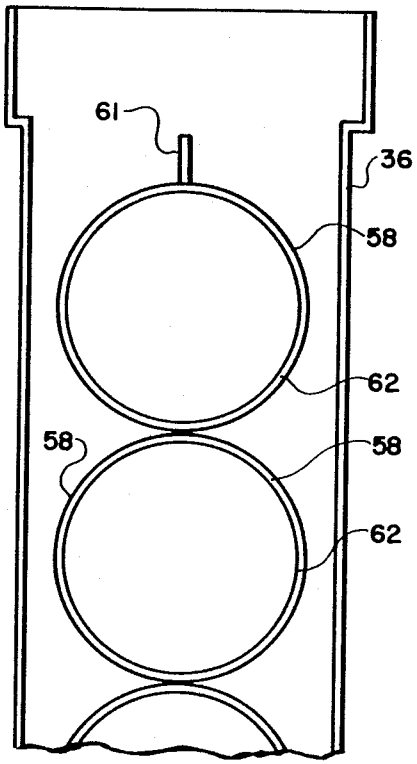
FIG. 7 is a front elevational view of a fourth embodiment of downspout member according to the present invention.

FIGS. 6 and 7 illustrate alternative structures for providing wettable surfaces of serpentine-like surface configurations similar to the deflector arrangements of FIGS. 1–4 and FIG. 5. Basically, in each of FIGS. 6 and 7, a plurality of circular members are affixed to the transverse wall 47 of a downspout member 36 in stacked abutting relation along the length of the channel 37 thereof to present a continuous serpentine-like wettable surface along the opposite lateral sides of the stacked arrangement of circular members. In FIG. 6, spherical balls 60 are utilized as the circular members to provide a substantially continuous wettable surface 58 along the entire peripheries of the spherical balls 60 except for the small areas thereof by which they are affixed to the transverse wall 47 and to one another. In the embodiment of FIG. 7, a plurality of cylindrical members 62 stacked in axially parallel arrangement are utilized as the circular members. In each case, the arcuately curving peripheries of the balls 60 and cylindrical members 62 form continuous serpentine-like wettable surfaces which function in the same manner as the surfaces 58 of FIGS. 1–5 to control run-off water contacting the deflector balls 60 and cylinder 62 to flow sheetingly along their peripheries to retain run-off water within the channel 37 and to transport leaves and other debris therethrough without clogging.

In each of the deflector arrangements of FIGS. 6 and 7, a flange member 61 projects upwardly from the uppermost one of the circular members to deflect leaves and like debris laterally to one side or the other to prevent any such debris from settling into resting engagement across the upward surface of the uppermost circular member which may promote clogging of the channel 37.

Figure 8:
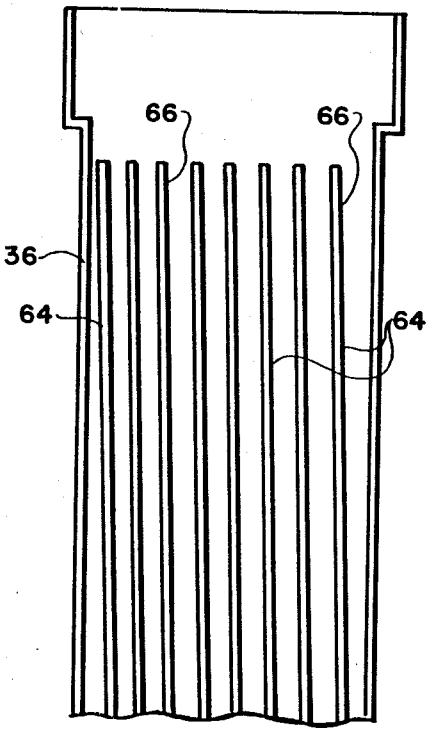
FIG. 8 is a front elevational view of a fifth embodiment of downspout member according to the present invention.

The downspout structure of FIG. 8 provides a plurality of substantially planar deflector partition plates 64 mounted side-by-side in substantially parallel spaced relation to one another to the transverse wall 47 of a downspout member 36 to extend continuously along substantially the entire length of the channel 37 thereof. In operation, run-off water entering the upper end 36′ of the downspout member 36 will normally be of sufficient splashing turbulence that substantially all such run-off water contacts the partition plates 64, the opposite side surfaces of each plates 64 acting as wettable contact surfaces to cause the run-off water to flow sheetingly along the partition plate 64 to be retained within the channel 37. To enhance the contact of run-off water with the partition plate 64, the downspout member 36 may be mounted to the building wall 16 at a slight angle with respect to vertical or, alternatively as shown in FIG. 8, the partition plates 64 may be mounted within the downspout member 36 at a similarly slight angle with respect to its side walls 46. The spacing between the partition plates 64 is suitably small to substantially prevent the passage of leaves and similar debris between the partition plates 64, and the upwardly facing edges 66 of the partition plates 64 are angled in correspondence to one another downwardly and outwardly of the channel 37 to deflect and expel leaves and like debris outwardly from the channel 37 (see FIG. 9).

Figure 10:
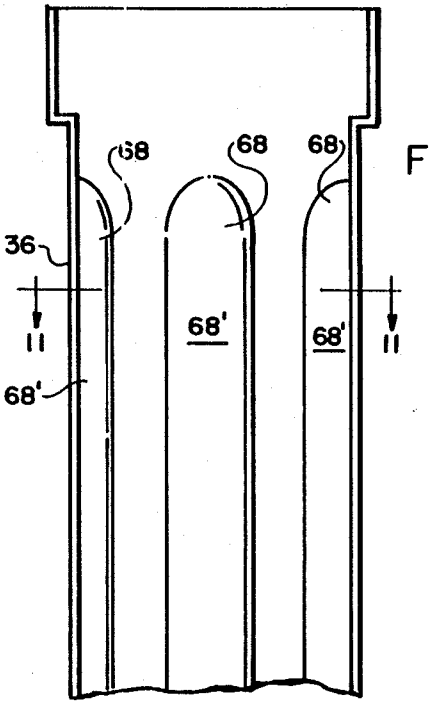
FIG. 10 is a front elevational view of a sixth embodiment of downspout member according to the present invention.
Figure 9:
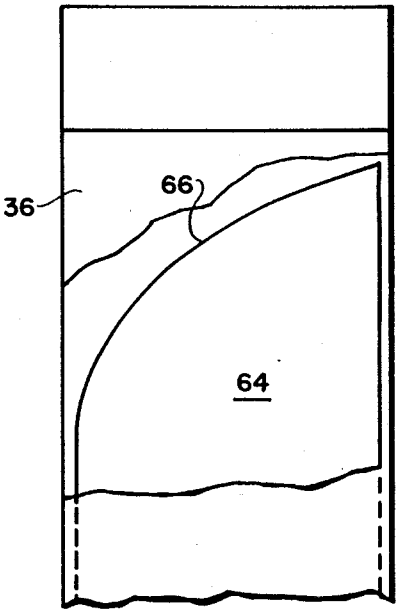
FIG. 9 is a side elevational view, partially broken away, of the downspout member of FIG. 8.

The downspout structure of FIG. 10 utilizes a generally U-shaped downspout member 36 which is formed with longitudinal corrugations 68 in each side and transverse wall 46,47 of the downspout member 36 forming inwardly-extending transversely convex wettable surface portions 68′ extending along substantially the entire length of the channel 37 to form wettable water contact surfaces. Under conditions of steady run-off water flow through the gutter 12 and the neck member 38, the run-off water will be discharged from the neck member 38 into contact with each of the side and transverse walls 46,47 and the corrugations 68 therein to flow sheetingly along the inner surfaces of the channel 37 of the downspout member 36. To insure run-off water contact with the corrugation 68 under conditions of a relatively low flow of run-off water, the transverse wall 53 of the neck member 38 may be formed with an upwardly extending central longitudinal ridge 70 along its rearward end 38″ to cause run-off water to flow within the lateral channel areas 39′ under conditions of low run-off water flow to insure discharge of run-off water into contact at least with the lateral corrugations 68 in the side walls 46 of the downspout member 36. As an alternative to the corrugated downspout member of FIG. 10, a U-shaped downspout member of the flat-walled construction of the downspout members 36 of FIGS. 1–4, 5, 6, 7 or 8 may be utilized and provided with small diameter cylindrical tubes affixed in parallel upright disposition at lateral spacings along the length of the inward surfaces of the side and transverse walls 46,47 to provide an essentially equivalent structure.

Figure 13:
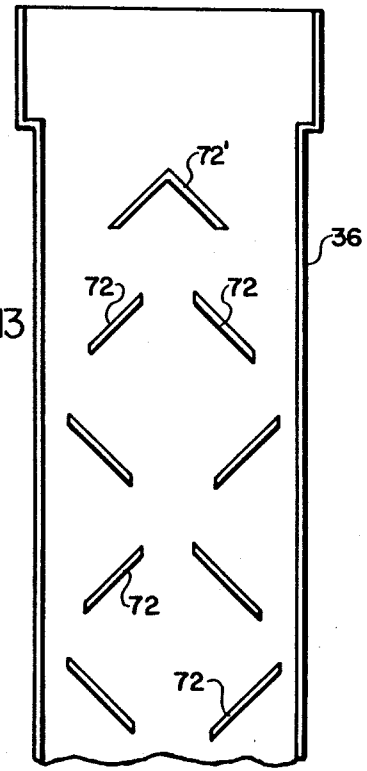
FIG. 13 is a front elevational view of a seventh embodiment of downspout member according to the present invention.
Figure 12:
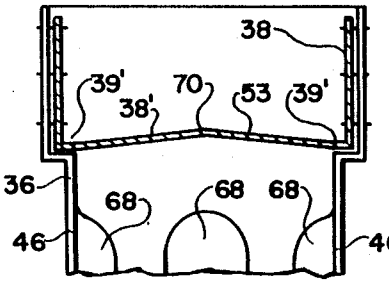
FIG. 12 is a vertical cross-sectional view of a trough member particularly adapted for use with the downspout member of FIG. 10, taken at the location of their joinder vertically through the terminal end of the trough member.
Figure 11:
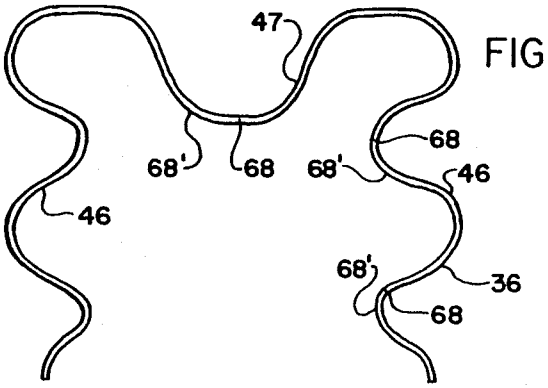
FIG. 11 is a horizontal cross-sectional view of the downspout member of FIG. 10 taken along line 11—11 thereof.

In the downspout structure of FIG. 13, a plurality of individual deflector plate members 72 are affixed to the transverse wall 47 of a downspout member 36 angularly relative to the longitudinal extent of the channel 37 thereof with the deflector plate members 72 arranged in transversely staggered relation to one another at spacings along the length of the channel 37. The uppermost deflector plate member 72′ is of an inverted V-shape to deflect run-off water received from the neck member 38 laterally into contact with the deflector plate members therebelow. In this manner, each deflector plate member 72 is effective along the extent thereof to cause run-off water contacting it to flow sheetingly therealong and is effective to discharge the flowing run-off water in a waterfall-like fashion downwardly onto the next deflector plate member 72 therebelow to effectively retain the run-off water within the channel 37 in similar fashion to the other deflector arrangements described above.

As will thus be understood, the downspout structure of the present invention is uniquely capable of handling substantially increased quantities of run-off water in a rainwater ducting system while substantially preventing clogging of the downspout structure by leaves and other debris which typically collect and accumulate in such systems and furthermore permitting easy cleaning and maintenance of the downspout structure. It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A downspout structure for discharging run-off water from a building gutter or the like, said downspout structure comprising means defining an elongate generally U-shaped open channel adapted for generally upright disposition for receiving said run-off water adjacent an upper end of said channel-defining means and directing said run-off water to a lower discharge end thereof, said channel-defining means including water deflector means interiorly of said channel arranged along the length thereof for controlling the flow of said run-off water to retain said run-off water within said channel, said channel permitting the expulsion of leaves and other debris from said channel to prevent clogging thereof and to facilitate easy cleaning thereof.

2. A downspout structure according to claim 1 and characterized further by means adapted for mounting to said channel-defining means at said upper end thereof for extending between said gutter and said channel-defining means for diverting said run-off water into contact with said deflector means of said channel-defining means at said upper end thereof.

3. A downspout structure according to claim 1 and characterized further by means at said upper end of said channel-defining means for expelling leaves and like debris outwardly of said open channel.

4. A downspout structure according to claim 1 and characterized further in that said deflector means forms wettable surface means extending continuously for substantially the entire length of said channel.

5. A downspout structure according to claim 4 and characterized further in that said wettable surface means is of a serpentine-like surface configuration.

6. A downspout structure according to claim 5 and characterized further in that said deflector means includes a sinuous-shaped deflector plate extending substantially the entire length of said channel and presenting a sinuous wettable surface on each opposite side of said plate.

7. A downspout structure according to claim 6 and characterized further in that said deflector means includes a pair of said deflector plates arranged side-by-side transversely across said channel.

8. A downspout structure according to claim 7 and characterized further in that said deflector means includes a deflector flange arranged above and extending transversely intermediately of said deflector plates to direct said run-off water onto each said deflector plate and to prevent clogging of leaves and like debris across said deflector plates at their upper ends.

9. A downspout structure according to claim 5 and characterized further in that said deflector means includes a plurality of circular members arranged in stacked relation along the length of said channel to present a continuous serpentine-like wettable surface along the opposite lateral sides of said stacked arrangement of said circular members.

10. A downspout structure according to claim 9 and characterized further in that each said circular member is spherical in shape.

11. A downspout structure according to claim 9 and characterized further in that each said circular member is cylindrical in shape, said circular members being stacked in axially parallel arrangement.

12. A downspout structure according to claim 9 and characterized further in that said deflector means includes a deflector flange extending upwardly from the uppermost one of said circular member to deflect leaves and other debris from coming into resting surface contact across said uppermost circular member.

13. A downspout structure according to claim 4 and characterized further in that said deflector means includes transversely convex surface portions at and extending inwardly from each side of said channel.

14. A downspout structure according to claim 13 and characterized further in that said channel-defining means is corrugated in transverse section substantially the entire length of said channel.

15. A downspout structure according to claim 4 and characterized further in that said deflector means includes a plurality of deflector partition plates extending side-by-side along substantially the entire length of said channel.

16. A downspout structure according to claim 15 and characterized further in that said deflector partition plates are arranged in substantially parallel relation to one another at a slight angle with respect to vertical to insure contact of said run-off water with said deflector partition plates.

17. A downspout structure according to claim 15 and characterized further in that said deflector plates have corresponding respective upper edges extending angularly downwardly and outwardly of said channel to expel leaves and like debris outwardly from said channel.

18. A downspout structure according to claim 1 and characterized further in that said deflector means includes a plurality of deflector members arranged angularly relative to the longitudinal extent of said channel in transversely staggered relation at spacings along the length of said channel.

19. A downspout structure for discharging run-off water from a building gutter or the like, said downspout structure comprising means defining an elongate generally U-shaped open channel adapted for generally upright disposition for receiving said run-off water adjacent an upper end of said channel-defining means and directing said run-off water to a lower discharge end thereof, said channel-defining means including water deflector means interiorly of said channel arranged along substantially the length thereof forming wettable surface means adapted for causing run-off water contacting said deflector means to flow sheetingly therealong to said lower discharge end of said channel-defining means to cause said run-off water to be retained within said channel and to transport leaves and other debris through said channel to prevent clogging thereof, said open channel permitting the expulsion of leaves and other debris from said channel along the entire length thereof to further prevent clogging thereof and to facilitate easy cleaning thereof.

* * * * *